US006908352B2

(12) United States Patent
Richards

(10) Patent No.: US 6,908,352 B2
(45) Date of Patent: Jun. 21, 2005

(54) TOWABLE WATERSPORTS HANDLE ASSEMBLY

(75) Inventor: Andrew Richards, Portland, OR (US)

(73) Assignee: Straight Line Sports, LLC, Portland, OR (US)

( * ) Notice: Subject to any disclaimer, the term of this patent is extended or adjusted under 35 U.S.C. 154(b) by 0 days.

(21) Appl. No.: 10/652,734

(22) Filed: Aug. 29, 2003

(65) Prior Publication Data

US 2005/0048854 A1 Mar. 3, 2005

(51) Int. Cl.[7] ..... B63B 35/85
(52) U.S. Cl. ..... 441/69; 114/253
(58) Field of Search ..... 441/69; 114/253

(56) References Cited

U.S. PATENT DOCUMENTS 4,374,638 A * 2/1983 Presser ..... 441/69
4,392,833 A * 7/1983 Hayden ..... 441/69
4,740,181 A * 4/1988 Kell ..... 441/69
4,863,407 A * 9/1989 Casad ..... 441/69

* cited by examiner

*Primary Examiner*—Lars A. Olson
(74) *Attorney, Agent, or Firm*—Alleman Hail McCoy Russell & Tuttle LLP

(57) ABSTRACT

The present invention provides a towable watersports handle assembly such as might be used for waterskiing, wakeboarding, etc. The towable watersports handle assembly may include a grip adapted to provide the user with a grippable surface, a bridle, and a fastening device configured to reversibly secure the bridle to the grip such that a user can quickly and easily remove and replace the grip.

16 Claims, 3 Drawing Sheets

TOWABLE WATERSPORTS HANDLE ASSEMBLY

BACKGROUND AND SUMMARY OF THE INVENTION

A number of towable watersports including waterskiing, tubing, barefoot skiing, wakeboarding and the like have enjoyed significant success lately. Generally, the user, or rider, is towed by a main rope that is pulled behind a boat, watercraft, or other towing vessel. The rope usually terminates in a handle assembly that is held by the user.

A typical handle assembly is a Y shaped piece including a grip, a bridle, and a yoke. The grip is typically a cylindrical rod covered with a gripable material. A bridle, which in some cases is made of rope, generally extends from each end of the grip and connects to the yoke. The yoke (or a lead rope extending from the yoke) is then connected to the main rope.

Grips typically wear out much faster than the other parts of the handle assembly. However, because most grips cannot be removed from the handle assembly, which is sold as a single unit, users are forced to purchase an entire handle assembly each time the grip wears out. This increases costs to the user and wastes material and manufacturing effort as users are forced to replace bridles and ropes that are in usable condition.

Moreover, a number of different grips are available. For example, different types of towable watersports (i.e. waterskiing versus wakeboarding) may use different styles of grips, and even grips for the same sport may come in different shapes, sizes, and/or colors. Accordingly, a particular user may wish to use different grips at different times. For example, a user may wish to use a specific grip for competition and another grip for practice. Additionally or alternatively, two users sharing the same boat and main rope may wish to use different grips.

Triton sports (www.tritonsports.com) makes a handle system under their Hardline brand called the Detachable Handle System (DHS). However, in order for a user to detach the grip from the bridle, the user must, for each end of the handle, first peel back a rubber piece covering the grip/bridle interface and then, while holding the rubber piece back, use a screw driver to unscrew a small metal screw that joins the bridle to the grip. In order to reattach the grip (or attach a new grip), the user must insert the bridle connector into the grip in the proper orientation such that the holes in the grip align with the holes in the bridle connector, move the rubber piece out of the way, and use a screwdriver to reattach the pieces with the screw. Such a system does not allow for quick removal and replacement of the grip, particularly when a user is wet and/or in the water.

Thus, it would be desirable to have an easily interchangeable handle that allows the grip to be quickly and easily removed from the handle assembly and a different grip inserted without requiring detachment and/or replacement of the rest of the handle assembly.

SUMMARY OF THE INVENTION

In a first embodiment, the present invention provides a towable watersports handle assembly comprising a grip adapted to provide a grippable surface, a bridle, and a manually attachable fastening device configured to reversibly secure the bridle to the grip.

In another embodiment, the present invention provides a towable watersports handle assembly comprising a grip including a first and second orifice, a bridle, and a bushing. Thus bushing may comprise a first portion adapted to receive and secure the bridle to the bushing, and a second portion adapted to secure the bushing to the grip. The second portion may include first and second legs extending from the first portion. The first leg may include a first detent and the second leg may include a second detent. The first and second detents may be adapted to seat inside the first and second orifices, reversibly securing the bushing to the grip thereby.

In still another embodiment, the present invention provides a tool for use with an interchangeable towable watersports handle assembly, where the towable watersports handle assembly may include a grip including at least one orifice, a bridle, and a bushing configured to reversibly secure the grip to the bridle, and further where the bushing may be secured to the grip by a detent extending from the bushing and configured to be inserted into the orifice. The tool may comprise a biasing member configured to urge the detent out of the orifice in a single motion, thereby freeing the bushing from the grip.

The advantages of the present invention will be understood more readily after a consideration of the drawings and the Detailed Description.

DETAILED DESCRIPTION AND BEST MODE OF THE INVENTION

In one aspect, the present invention provides a towable watersports handle assembly including a grip that can be quickly and easily removed. Typically, the grip is reversibly connected to the bridle by a manually attachable fastening device. As used herein, a manually attachable fastening device or manipulable device includes a device that may be operated by using human force rather than mechanical force. Human force includes operation or control by skilled use of hands. For example, a manually attachable fastening device may include a fastener adapted to be attached without the use of machines or tools, such as, but not limited to, screwdrivers, wrenches, pliers, etc. The manually attachable fastening device may be manually detachable as well, by which it is meant that the fastener may be adapted to be detached without the use of machines or tools, such as, but not limited to, screwdrivers, wrenches, pliers, etc. In some embodiments, the fastening device may be manually attachable, but require a specific tool to be detached, in order to prevent accidental detachment of the device while the handle assembly is in use.

Figure 1:
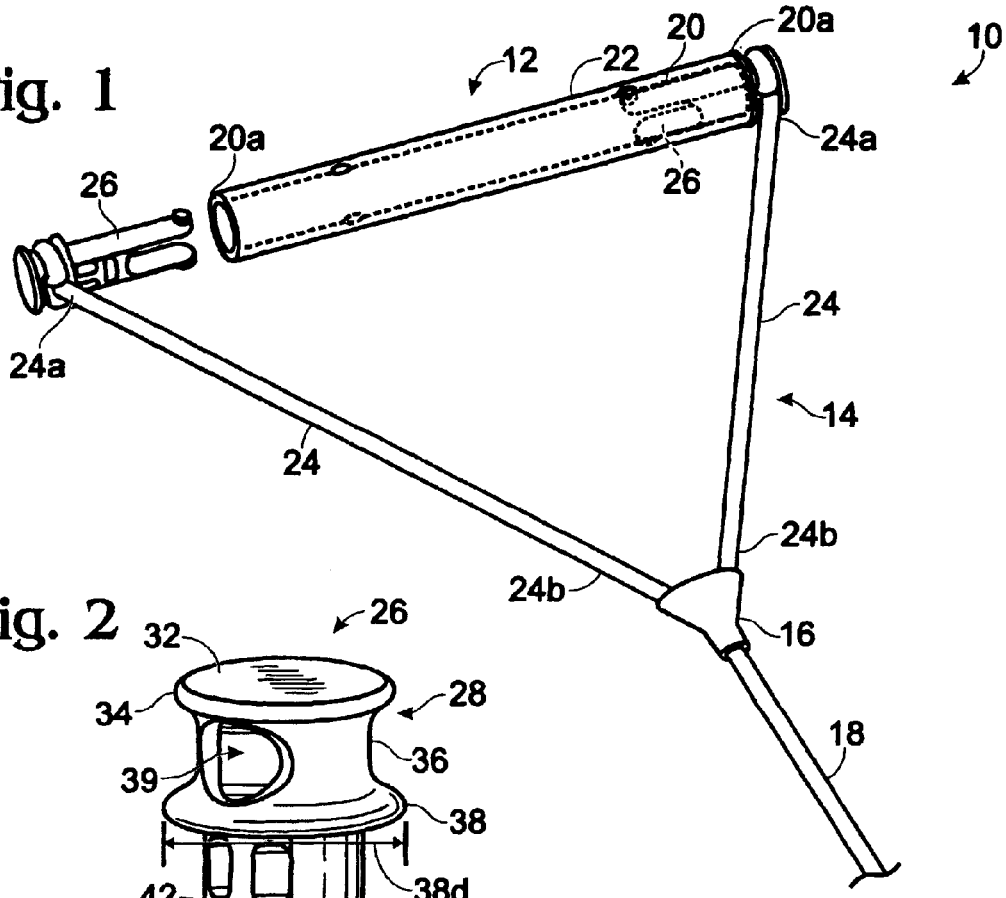
FIG. 1 depicts a first embodiment of an interchangeable handle system according to the present invention.

FIG. 1 shows an exemplary towable watersports handle assembly 10 according to a first embodiment of the present invention. As shown, towable watersports handle assembly 10 includes a grip 12 connected to a bridle 14. Bridle 14 may include a pair of ropes 24, which are joined to and extend from the ends 20*a* of bar 20 to yoke 16, typically forming a V- or Y-shaped configuration. For ease of discussion, each rope 24 will be referred to as having a bar end 24*a* and a yoke end 24*b*. Yoke 16 may connect directly to a main line, or towrope 18. Alternatively, a lead rope (not shown) may extend from the yoke and rather than connecting directly to the yoke, the main line may connect to the lead rope.

Grip 12 typically includes a bar 20, which is surrounded by a cushioned layer 22. While other shapes are contemplated by the present invention, bar 20 is typically a hollow cylinder and may be formed of a sturdy, lightweight material such as aluminum. Layer 22 is typically formed of a non-slip material such as foam, rubber, or the like.

In the presently described embodiment, the bar end 24*a* of each rope 24 is joined to a bushing 26. As shown bushing 26 is adapted to be removably secured inside of grip 12.

Figure 2:
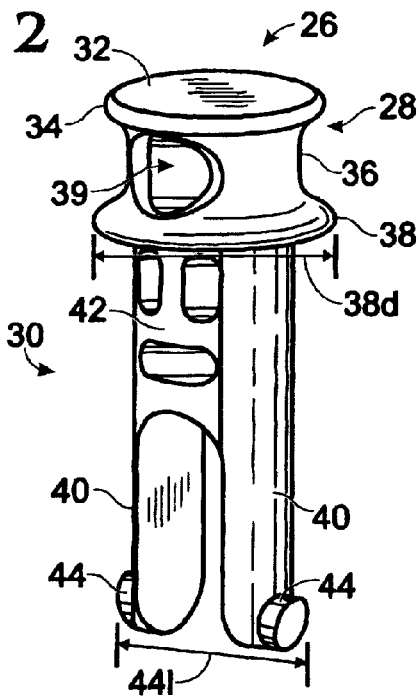
FIG. 2 is a close-up perspective view of a bushing useful in the interchangeable handle system shown in FIG. 1.

FIGS. 2–8 present a close-up view of the relationship between bushing 26 and grip 12. FIG. 2 is a close-up illustration of an exemplary bushing 26. Bushing 26 may be formed of any suitable material including, for example, plastic. As shown, bushing 26 includes a spool portion 28 and a locking portion 30.

Spool portion 28 typically includes an external surface 32 defining a rim 34, a recessed region 36 and a collar 38. Recessed region 36 typically includes a bore 39, through which rope 24 may be threaded and then secured to bushing 26.

Collar 38 is situated between spool portion 28 and locking portion 30. Collar 38 provides a surface against which bar 20 may abut when bushing 26 is inserted into bar 20. Thus collar 38 is typically sized to have a diameter 38*d* larger than the internal diameter 20*d* of bar 20 (as shown in FIG. 3).

Returning to FIG. 2, locking portion 30 includes a pair of legs 40 extending from central region 42. Each leg 40 includes a detent 44, which is perpendicular to and radiates outward from the leg. Typically, the distance 44*l* between the distal ends of detents 44 is larger than the internal diameter 20*d* of bar 20 (again referring briefly to FIG. 3). However, legs 40 are adapted to provide a certain degree of radial give or movement such that the legs can be pinched together (as shown in FIG. 4) in order to insert the locking portion 30 of bushing 26 into the end of bar 20.

Figure 3:
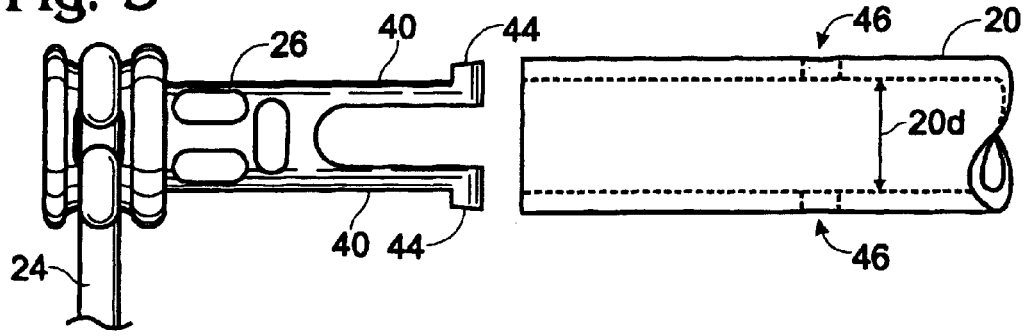
FIG. 3 is a partial perspective view of the interchangeable handle system shown in FIG. 1 depicting the bushing and grip.
Figure 4:
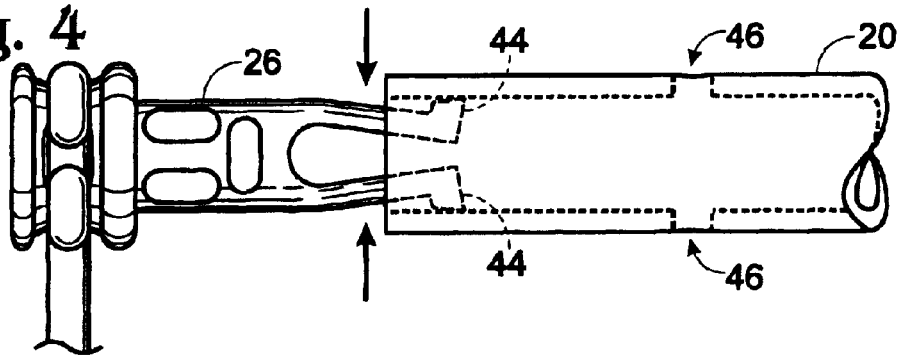
FIG. 4 is a partial perspective view of the interchangeable handle system shown in FIG. 1 depicting the bushing being inserted into the grip.
Figure 5:
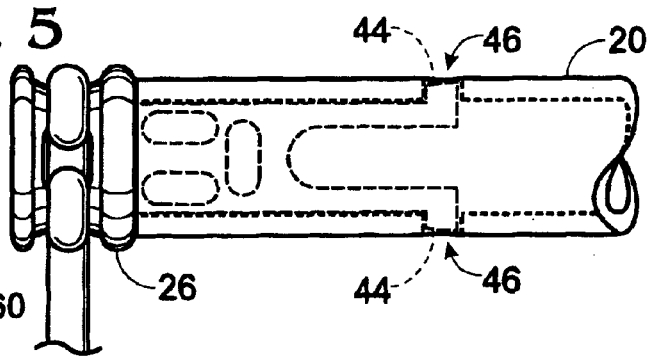
FIG. 5 is a partial perspective view of the interchangeable handle system shown in FIG. 1 depicting the bushing fully inserted into the grip.
Figure 6:
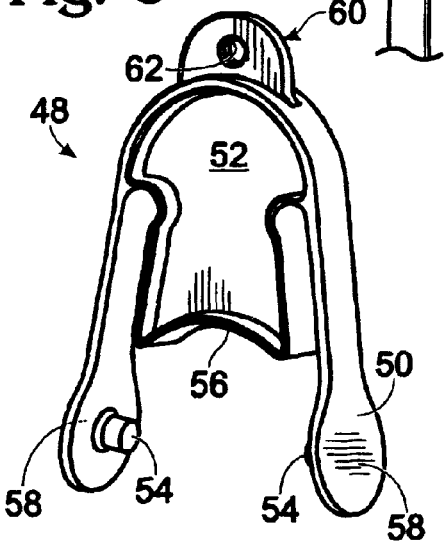
FIG. 6 is a close-up perspective view of a uncoupling tool suitable for use with the interchangeable handle system shown in FIG. 1.

Turning to FIG. 3, each end of bar 20 includes a pair of orifices 46 extending through the bar. The orifices are sized and spaced to receive detents 44 when bushing 26 is inserted into the bar. Thus, as shown in FIG. 4, legs 40 are pinched together in order to insert the bushing 26 into bar 20. The legs are typically pinched together manually, for example, a user may grasp the bushing while squeezing the legs together and then insert the legs into the bushing. Legs 40 are then released in order to allow detents 44 to seat inside orifices 46, as shown in FIG. 5 thus locking bushing 26 to bar 20. In addition, legs 40 may be somewhat outwardly biased, i.e. biased away from each other, creating a tension fit between locking portion 30 and bar 20 when the locking portion is inserted into bar 20. Thus, bushing 26 acts as a manually attachable fastening device.

Moreover, as shown, the user can secure bushing 26 to grip 12 simply by inserting the distal end of the bushing into the grip and pushing the two pieces together until the detents on the bushing pop into the orifices on the grip. Thus, rather than requiring the user to perform multiple steps or actions to attach the bushing to the grip, the user can attach the bushing to the grip with a single step or motion.

Bushing 26 can be released from bar 20 by the use of uncoupling tool 48. An exemplary uncoupling tool is shown in detail in FIG. 6. Uncoupling tool 48 is typically formed of a flexible yet resilient material such as plastic. Uncoupling tool 48 includes a pair of arms 50 extending from a central region 52. Each arm 50 includes a pin 54 that extends perpendicular to and radiates inward from the arm. Pins 54 are sized and spaced to fit into orifices 46. Central region 52 may include a curved seat 56, which may be adapted to match the external contour of handle 12. Each arm of uncoupling tool 48 may further include a pad 58 sized and configured so that the pad can be grasped by a user's fingers.

Figure 7:
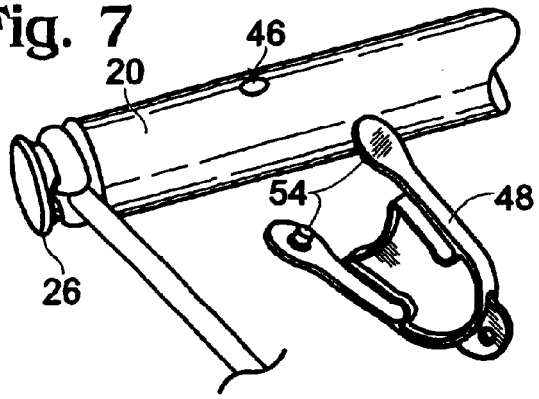
FIG. 7 is a partial perspective view of the interchangeable handle system shown in FIG. 1 showing the uncoupling tool being positioned on the grip.
Figure 8:
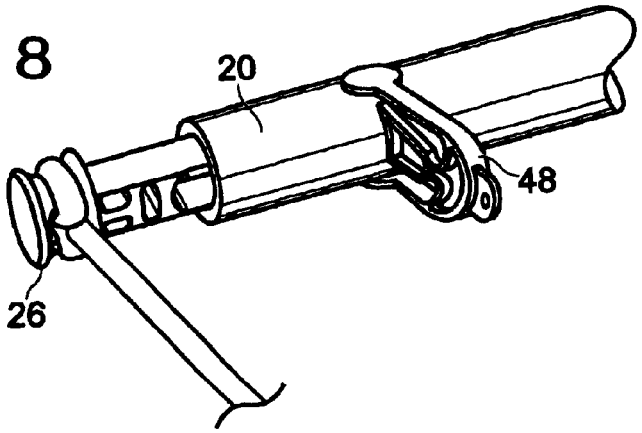
FIG. 8 is a partial perspective view of the interchangeable handle system shown in FIG. 1 as the bushing is being released from the grip.

When grip 12 is properly engaged by uncoupling tool 48, arms 50 are disposed so as to reach on either side of the grip, as shown in FIG. 7. Grip 12 can positioned such that pins 54 on uncoupling tool 48 align with detents 44 on bushing 26. Arms 50 of uncoupling tool 48 can then be urged inwards so as to push detents 44 inwards, thereby pinching legs 40, and allowing bushing 26 to slide out of bar 20, as shown in FIG. 8.

Because uncoupling tool 48 may be used outside, on a boat, or even in the water, uncoupling tool 48 may further include an attachment region 60, which in the depicted example includes an orifice 62 through which a rope, string, wire, hook, or the like may be threaded or inserted, allowing the tool to be secured to a person, object, or location.

Figure 9:
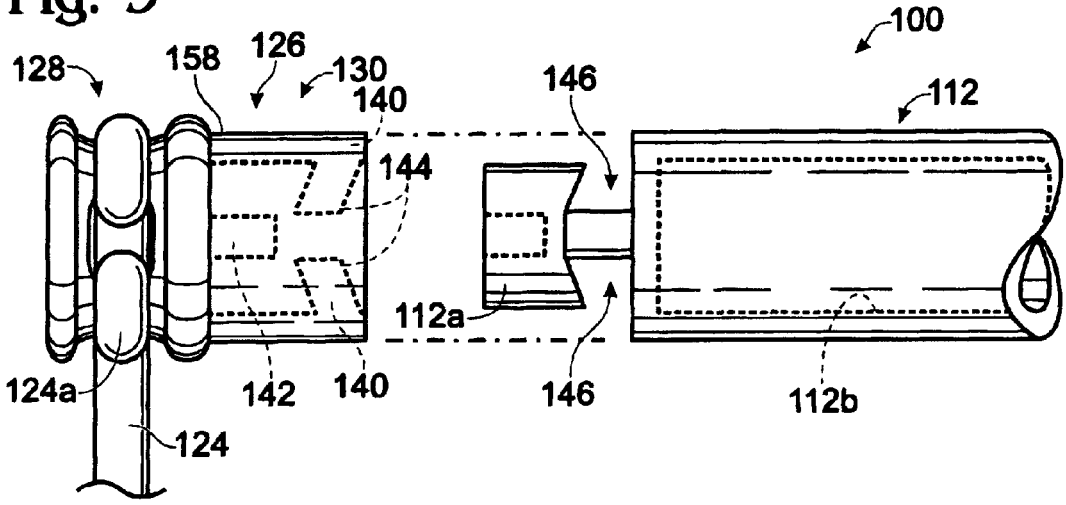
FIG. 9 is a partial perspective view of another embodiment of an interchangeable handle system according to the present invention.

Another embodiment of a towable watersports handle assembly according to the present invention is shown in FIG. 9. In the depicted embodiment, towable watersports handle assembly 100 includes a grip 112 connected to a bridle 114. As with the example above, grip 112 typically includes a bar 120, which his surrounded by a cushioned layer 122. Bridle 114 may include a pair of ropes 124, which are joined to and extend from the ends 120*a* of bar 120 to a yoke (not shown), which may then be connected to a main line (also not shown.) As with the above-described embodiment, the bar end 124*a* of each rope is joined to a bushing 126. However, instead of the bushing being inserted into the bar in order to reversibly attach the bridle to the handle as described above, a portion of bar 120 is inserted into bushing 126.

As shown, bushing 126 includes a spool portion 128, which may be similar in design and function to spool portion 28, described above with reference to FIGS. 1–8. Bushing 126 further includes a locking portion 130. Locking portion 130 includes a pair of legs 140, which extend axially downwards from an outer circumferential region of spool portion 128. A central drum 142 extends axially downwards from a central region of spool portion 128. Legs 140 and central drum 142 are sized and spaced appropriately so that bar 120 can be received by and sandwiched between legs 140 and central drum 142. Moreover, each leg 140 includes a detent 144, which is perpendicular to and radiates inward from the leg. Grip 112 includes a notched region 146 at each end. Notched region 146 is adapted to receive and retain a detent 144 when grip 112 is received by bushing 126.

As shown, legs 140 may include gripping material 158 so as to provide a uniform gripping region. Moreover, the portions 112*a* of grip 112 which are received by bushings 126 may be of a smaller diameter than central portion 112*b* and bushings 126 may have the same diameter as central portion 112, so as to provide a uniform surface along the entire length of the grip.

Figure 10:
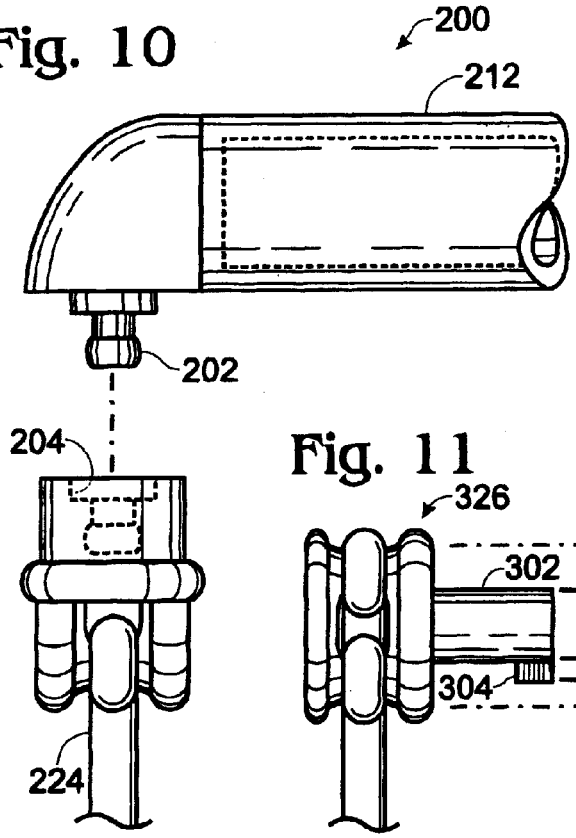
FIG. 10 is a partial perspective view of yet another embodiment of an interchangeable handle system according to the present invention.

Another embodiment of a towable watersports handle assembly according to the present invention is shown in FIG. 10. The towable watersports handle assembly 200, shown in FIG. 10, includes a grip 212 including a male snap-lock member 202 affixed at each end. Bridle ropes 224 each terminate in a female snap-lock member 204. The male snap-lock members can be removably inserted into the female snap lock members to create a secure, reversible, connection between grip 212 and bridle ropes 224. Of course it will be appreciated that the positions of the male and female snap-lock members could be reversed, that is, the handle could include a female snap-lock member and the bridle ropes could terminate in a male snap-lock member.

Figure 11:
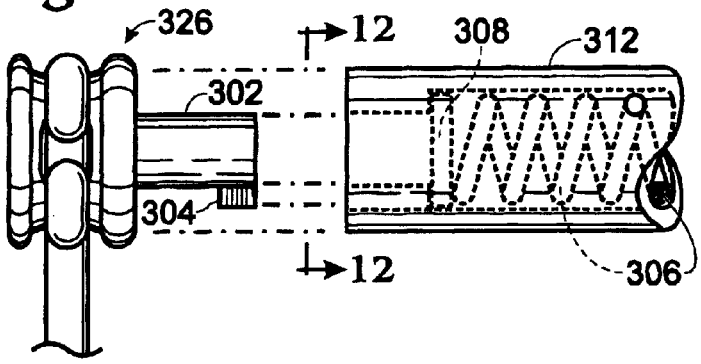
FIG. 11 is a partial perspective view of still another embodiment of an interchangeable handle system according to the present invention.
Figure 12:
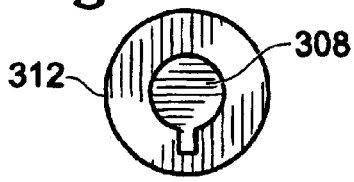
FIG. 12 is a perspective view of a pressure plate suitable for use in the interchangeable handle system shown in FIG. 11.

Another embodiment of a towable watersports handle assembly according to the present invention is shown in FIGS. 11 and 12. The towable watersports handle assembly 300, shown in FIG. 11 includes a keyed bushing 326, which is configured to reversibly mate with a spring-loaded grip 312. As shown, bushing 326 includes an extension member 302 including a tooth 304. Bar 320 includes a spring 306, which terminates on both ends in a pressure plate 308. As shown in FIG. 12, pressure plate 308 includes a keyhole region into which tooth 304, when properly oriented, may be inserted.

Additional examples of towable watersports handle assemblies including easily interchangeable grips, many of which include a manually attachable fastening device, are described briefly below.

In a first example, the towable watersports handle assembly includes a bushing having a collet design. The bushing is designed to expand inside the bar as a hex bolt is tightened into the bar through a hole in the end of the bushing. The arms that extend into the bar expand as the bolt is tightened, thus creating pressure on the inside wall of the bar and securing the bushing.

In an alternative example, an interchangeable handle system may include a bushing having a hex-head. In this embodiment, a threaded rod runs the length of the inside of the bar and is secured into the opposite bushing by tightening the hex head.

In yet another example, each end of the grip may include a snap fitting with a sleeve that slides over a ring. The snap fitting rings hold the bushings in place with tabs that are formed into their geometry. These tabs can go through holes in the bar and into the bushings. A rubber or soft plastic sleeve will then be slid over the clip, preventing it from coming off during use.

In another example, an interchangeable handle system according to the present invention may include a quick lock fitting similar to that used on a bicycle seat post or wheel hub. The ring-style fitting is slid over the end of the bar and the bushing are then placed in the bar ends. The fitting is then tightened and locked, pinching the bar around the bushings.

In yet another example of an interchangeable handle system according to the present invention, an interchangeable handle system may include a snap fitting at the yoke. This piece allows for the yoke and handle to be easily disconnected from the main line allowing for efficient bar swapping. The yoke is laid inside the fitting into a channel and secured by closing. The fitting may open and close like a clamshell, even, for example, making an audible clicking noise to alert the user that the fitting has been securely closed.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

Inventions embodied in various combinations and subcombinations of features, functions, elements, and/or properties may be claimed in a related application. Such claims, whether they are directed to a different invention or directed to the same invention, whether different, broader, narrower or equal in scope to any original claims, are also regarded as included within the subject matter of the inventions of the present disclosure.

What is claimed is:

1. A towable watersports handle assembly comprising:

a grip adapted to provide a grippable surface;

a bridle; and a manually attachable fastening device including a biasing member configured to reversibly secure the bridle to the grip; and a mechanism adapted to influence the biasing member so as to release the manually attachable fastening device from the grip.

2. The towable watersports handle assembly of claim 1, where the manually attachable fastening device is adapted to be secured to the grip in a single motion.

3. The towable watersports handle assembly of claim 1 where the manually attachable fastening device and biasing member are formed as a single unit.

4. A towable watersports handle assembly comprising:

a grip adapted to provide a grippable surface;

a bridle;

a manually attachable fastening device configured to reversibly secure the bridle to the grip, where the manually attachable fastening device includes a detent configured to be received by an opening in the grip and the manually attachable fastening device is secured to the grip thereby; and a mechanism adapted to release the detent from the opening.

5. A towable watersports handle assembly comprising:

a grip including a first and second orifice;

a bridle; and a bushing comprising:

a first portion adapted to receive and secure a bridle to the bushing; and a second portion adapted to secure the bushing to the grip, the second portion including first and second legs extending from the first portion, the first leg including a first detent, the second leg including a second detent, where the first and second detents are adapted to seat inside the first and second orifices, reversibly securing the bushing to the grip thereby:

where a portion of the grip is configured to be inserted into the bushing.

6. The towable watersports handle assembly of claim 5 where the second portion of the bushing is configured to be inserted into the grip.

7. The towable watersports handle assembly of claim 6 where the first and second legs are outwardly biased away from each other.

8. The towable watersports handle assembly of claim 7 where each detent is perpendicular to and extends radially outwards from each leg.

9. The towable watersports handle assembly of claim 5 where portion of the grip is configured to be inserted into the bushing between the first and second legs.

10. The towable watersports handle assembly of claim 9 where the first and second legs are inwardly biased towards each other.

11. The towable watersports handle assembly of claim 10 where each detent is perpendicular to and extends radially inwards from each leg.

12. A tool for use with an interchangeable towable watersports handle assembly including a grip including at least one orifice, a bridle, and a bushing configured to reversibly secure the grip to the bridle, where the bushing is secured to the grip by a detent extending from the bushing and configured to be inserted into the orifice, the tool comprising a biasing member configured to urge the detent out of the orifice in a single motion, thereby freeing the bushing from the grip.

13. The tool of claim 12 further comprising a pair of arms extending from a central region.

14. The tool of claim 13 wherein each arm includes a pin extending perpendicular to and radiating inward from the arm.

15. The tool of claim 13 where the central region includes a curved seat having an external contour that complements the external contour of the grip.

16. The tool of claim 13 where each arm includes a pad sized and configured so as to be grasped by a user's fingers.

* * * * *